United States Patent [19]

Elperin et al.

[11] Patent Number: 4,583,941

[45] Date of Patent: Apr. 22, 1986

[54] BURNER FOR GASEOUS FUEL

[75] Inventors: Freda Elperin, Beer Sheva; Abraham Tamir, Omer, both of Israel

[73] Assignee: Ben-Gurion University of the Negev Research and Development Authority, Beer Sheva, Israel

[21] Appl. No.: 522,532

[22] Filed: Aug. 12, 1983

[30] Foreign Application Priority Data

Aug. 13, 1982 [IL] Israel ..... 66538

[51] Int. Cl.[4] ..... F23D 14/12

[52] U.S. Cl. ..... 431/347; 431/354; 239/497; 239/461; 239/548; 126/39 R

[58] Field of Search ..... 431/347, 185, 354; 126/39 R, 39 H, 39 N, 39 J; 239/497, 496, 548, 461

[56] References Cited

U.S. PATENT DOCUMENTS

| | | | |
|---|---|---|---|
| 478,295 | 7/1892 | Squire et al. | 239/497 |
| 794,545 | 7/1905 | Phillips | 431/354 |
| 951,394 | 3/1910 | Hauck | 431/347 |
| 1,130,132 | 3/1915 | Antonuccio | 126/39 H |
| 1,757,023 | 5/1930 | Smith | 239/497 |
| 3,022,815 | 2/1962 | Bloom et al. | 431/185 |
| 4,419,074 | 12/1983 | Schuetz | 431/354 |

FOREIGN PATENT DOCUMENTS

| | | | |
|---|---|---|---|
| 41304 | 3/1980 | Japan | 431/354 |

*Primary Examiner*—Carroll B. Dority, Jr.
*Attorney, Agent, or Firm*—Keil & Weinkauf

[57] ABSTRACT

There is provided a gas-fuelled burner for producing a concentrated, rotating flame. The burner comprises a body including a plenum chamber into which gas and primary combustion air are introduced by a standard nozzle, which chamber is defined and delimited on its upper side by a roof element provided with a plurality of relatively narrow passgeways for the gas/air mixture, the passageways leading from the plenum chamber upwards and inwards to the upper, outside face of the burner. The passageways include angles with a common plane perpendicular to the vertical axis of the burner, and individual vertical planes substantially passing through the passageways are tangential to an imaginary vertical cylinder passing through the center of the burner.

5 Claims, 7 Drawing Figures

BURNER FOR GASEOUS FUEL

The present invention relates to a burner using a gaseous fuel, in particular a burner for domestic or industrial gas ranges using town or bottled gas.

While the merits of these burners, i.e., their simplicity, reliability, safety and low cost are universally acknowledged, they also suffer from substantial shortcomings, amongst which are: relatively low efficiency which, normally, does not exceed 55–60% and air pollution, mainly by carbon monoxide, due to incomplete combustion. Low efficiency is mainly caused by the large, radiating surface of the open, noninsulated flame, by excess air due to unlimited air suction from the surroundings into the open flame, by the low intensity of heat exchange between combustion products and the surface to be heated, as well as by the relatively small surface available for heat exchange. Incomplete combustion, on the other hand, is caused by a relatively short flame coming in contact with, and being excessively cooled by, the surface to be heated.

It is one of the objects of the present invention to provide a burner that produces a central, concentrated, combustion zone with a rotating vertical flame "column" which draws in secondary air as a function of the velocity of the gas/primary air mixture and therefore reduces the coefficient of air excess, thus promoting the fuel combustion process and intensifying heat exchange, while reducing wasteful radiation.

This the present invention achieves by providing a gas-fuelled burner producing a concentrated, rotating flame, comprising a body including a plenum chamber into which gas and primary combustion air are introduced by a standard nozzle, which chamber is defined and delimited on its upper side by a roof element provided with a plurality of relatively nanow passageways for said gas/air mixture, said passageways leading from said plenum chamber upwards and inwards to the upper, outside face of said burner, wherein said passageways include angles with a common plane perpendicular to the vertical axis of said burner, and wherein individual vertical planes substantially passing through said passageways are tangential to an imaginary vertical cylinder passing through the center of said burner.

The rotating concentrated flame is produced by the interaction of the plurality of gas/primary air jets forced to leave the plenum chamber via passageways which impart to these jets and upward and inward, as well as a tangential component. Hitting the flat surface to be heated, the quasi-helical path described by the flames is turned into a flat, multi-arm spiral, the length of each arm of which exceeds the length of the straight path along which the combustion products of conventional burners move. This of course enchances heat transfer and reduces heat losses.

Exhaustive tests performed by independent authorities have shown the burner according to the invention to have an efficiency 20–30% higher than the efficiency of conventional burners.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than in necessary for a fundamental understanding of the invention, the description taken with the drawings making apparent to those skilled in the art how the several forms of the invention may be embodied in practice. In the drawings:

Figure 1:
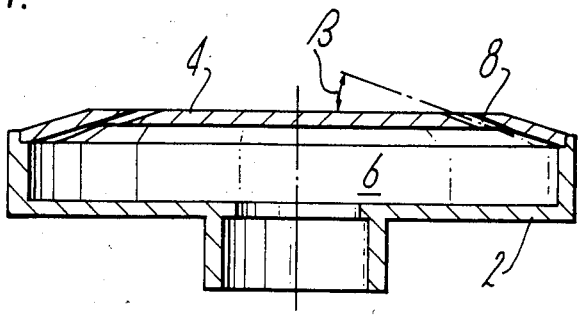
FIGS. 1 and 2 are a front view in cross section and a top view, respectively, of a first embodiment of the burner according to the invention.
Figure 2:
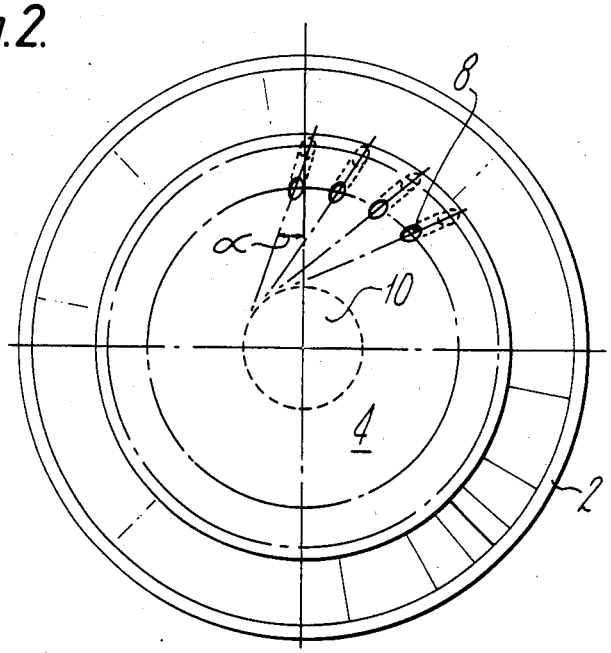

Referring now to the drawings, there is seen in FIGS. 1 and 2 a burner body 2 mountable on a standard venturi and nozzle unit (not shown), which, in conjunction with a roof plate 4, defines and delimits a plenum chamber 6. This roof element or plate 4 which, for purpose of cleaning of the entire burner, is advantageously detachable from the burner body 2, is provided with a plurality of passageways for the gas/primary air mixture to be turned. In this particular embodiment, these passageways are in the form of uniformly spaced holes 8 of a circular cross section. As can be seen in FIG. 1, these holes 8 lead from the plenum chamber 6 upwards and inwards, emerging on the upper face of the roof plate 4. The angle $\beta$ which these holes 8 include with the horizontal for optimal operation may vary between 15° and 40°. As can be seen in FIG. 2, vertical planes passing through the center of the holes 8 are not radial, but tangential to an imaginary vertical cylinder 10. The angle $\alpha$ included between these vertical planes and the corresponding radial planes passing through the center of the plenum-side openings may vary between 10° and 35° for optimal operation.

As has already been explained, this "double slant" of the holes produces a vertical, rotating flame "column" or vortex, the low-pressure zone inside which draws in the necessary secondary air, which constitutes about half of the combustion air required, the other half being constituted by the primary air reaching the plenum chamber 6 together with the gas.

Figure 3:
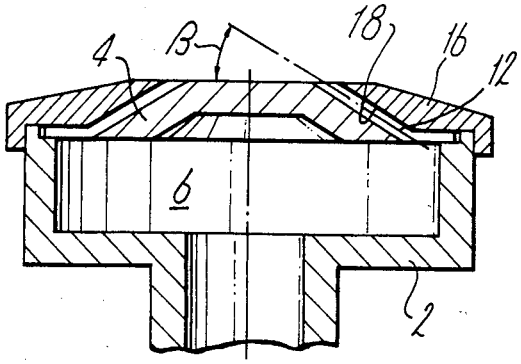
FIGS. 3 and 4 are similar representation of a second embodiment of the burner according to the invention.
Figure 4:
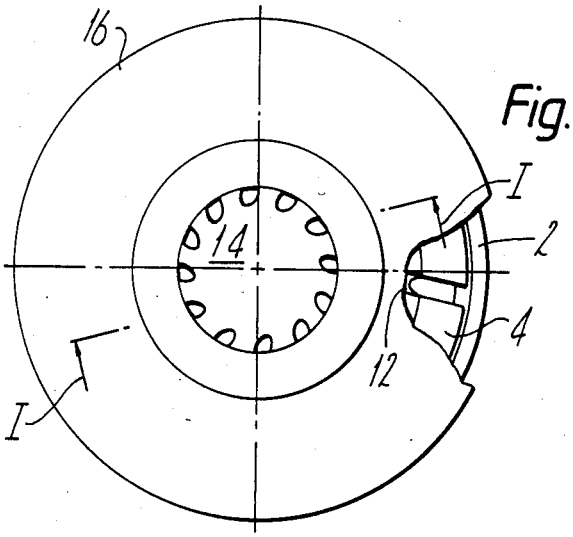
Figure 5:
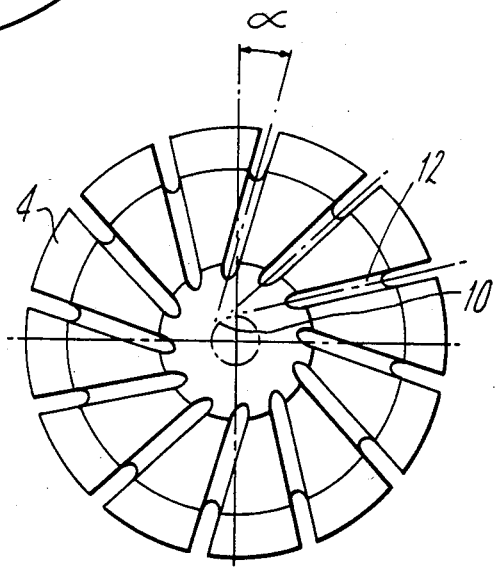
FIG. 5 is a top view of the roof plate of the embodiment of FIG. 3.

FIGS. 3–5 illustrate another embodiment of the burner. There is seen a burner body 2 which, basically, is similar to that of the previous embodiment. The roof plate 4, however, is different in that the passageways for the gas/primary air mixture are not holes, but grooves 12 which are milled into the tapering surface of the roof plate 4. In the present embodiment, these grooves 12 have a rounded bottom, as is clear from the shape produced where these grooves 12 break into the top surface 14 of the roof plate 4. These open grooves 12 are turned into passageways by being covered by a cover plate 16, the inside taper 18 of which fits the tapering surface of the roof plate 4. This embodiment, too, is characterized by the "double slant" $\alpha$ and $\beta$ of the passageways for the gas/primary air mixture. FIG. 5 also clearly shows the imaginary cylinder 10 defining the angle $\alpha$.

Figure 6:
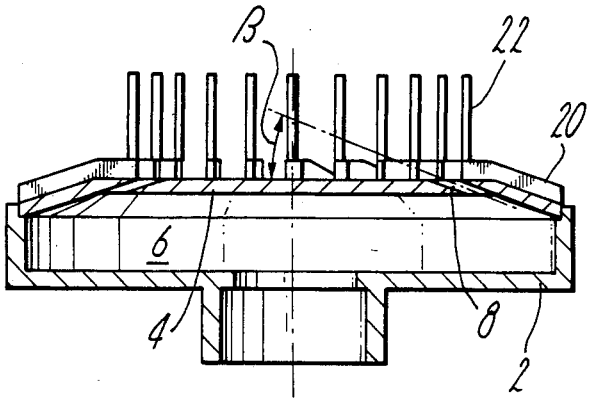
FIGS. 6 and 7 are a front view in cross section and a top view, respectively, of a third embodiment of the burner according to the invention.
Figure 7:
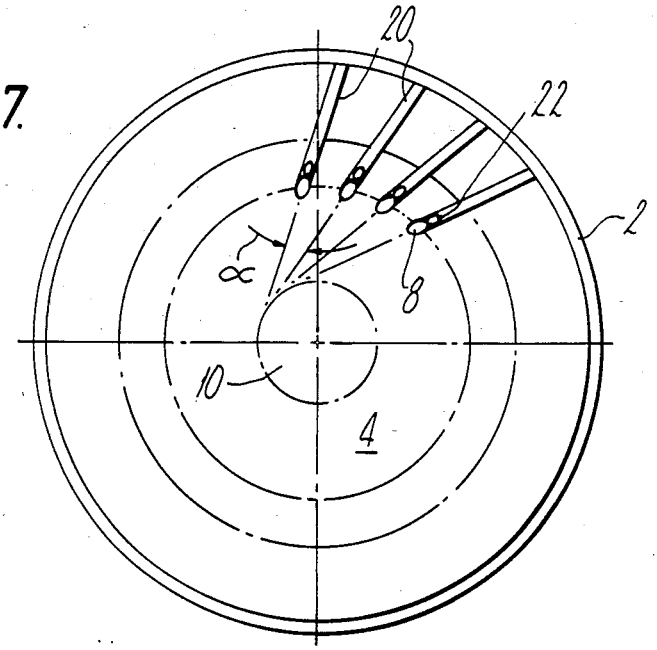

A third embodiment of the burner according to the invention is shown in FIGS. 6 and 7. While this embodiment incorporates the burner of FIGS. 1 and 2 in its entirety, it comprises two novel features, one being a plurality of fins 20 arranged on the peripheral zone of the outside surface and oriented in such a way as to lie within the above-mentioned vertical planes tangent to the imaginary cylinder 10. These fins 20 serve to guide as well as preheat the secondary air drawn in by the rotary flame as explained above. The second level feature is a plurality of relatively thin pins 22 mounted on the burner roof plate 4, in proximity to the points where the holes 8 emerge on the roof plate 4. These pins 22 are made from a material having catalytic properties, such as heat-resistant steel alloyed with certain heavy metals such as nickel, chromium or the like, which promote complete combustion of CO.

The importance of the flat spiral formed when the rotating flame hits the bottom of pots or pans has been pointed out before. However, in some gas ranges, the grids supporting these cooling utensils have long, horizontal arms reaching close to the center of the pot or pan, and thus interfering with the even spread of the spiral. In such cases, a number of relatively slender (4–5 mm diameter), upright rods, arranged along a circle appropriate in diameter to the size of the burner, could be attached to, or form an integral part of, the burner body 2 and serve as pan support that would offer only little resistance to the rotation of the flame.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A gas-fuelled burner producing a concentrated, rotating flame, comprising a body including a plenum chamber connected to a source of fuel gas and primary combustion air, which chamber is defined and delimited on its upper side by a roof element having a plurality of relatively narrow passageways for said gas/air mixture, said passageways leading from said plenum chamber upwards and inwards to the upper, outside face of said burner, wherein said passageways include angles with a common plane perpendicular to the vertical axis of said burner, and wherein individual vertical planes substantially passing through said passageways are tangential to an imaginary vertical cylinder passing through the center of said burner, the portion of said roof element located inwardly of said passageways being imperforate.

2. The burner as claimed in claim 1, wherein said passageways are constituted by holes provided in said roof element.

3. The burner as claimed in claim 1, wherein said roof element comprises a roof plate and a covering ring, and said passageways are constituted by grooves in the upper surface of said roof element, the open faces of which grooves are covered by the covering ring.

4. The burner as claimed in claim 1, further comprising secondary-air guiding and heating fins arranged on the peripheral zone of the upper outside face of said roof element and oriented in such a way as to substantially lie within said tangential vertical planes.

5. The burner as claimed in claim 1, further comprising a plurality of relatively thin plus mounted on the upper surface of said roof element in proximity to the points where said passageways emerge on said upper surface, said pins being made from a material having catalytic properties to promote complete combustion of CO.

* * * * *